United States Patent [19]

Theising

[11] Patent Number: 4,864,934

[45] Date of Patent: Sep. 12, 1989

[54] INDUSTRIAL SHOTSHELL HAVING A LOAD-STABILIZING ASSEMBLY

[75] Inventor: John L. Theising, Florissant, Mo.

[73] Assignee: Olin Corporation, Stamford, Conn.

[21] Appl. No.: 282,548

[22] Filed: Dec. 12, 1988

[51] Int. Cl.[4] ..... F42B 7/08

[52] U.S. Cl. ..... 102/430; 102/439; 102/448; 102/501; 102/517; 102/532

[58] Field of Search ..... 102/430, 439, 448–453, 102/501, 517, 520, 522, 523, 532

[56] References Cited

U.S. PATENT DOCUMENTS

| | | | |
|---|---|---|---|
| 3,285,174 | 11/1966 | Moehlman et al. . | |
| 3,669,023 | 6/1972 | Moehlman et al. . | |
| 3,720,171 | 3/1973 | Hubbard . | |
| 3,721,197 | 3/1973 | Hughes et al. . | |
| 4,043,267 | 8/1977 | Hayashi | 102/430 |
| 4,587,705 | 5/1982 | Maki | 102/430 |

*Primary Examiner*—Harold J. Tudor
*Attorney, Agent, or Firm*—Bruce E. Burdick

[57] ABSTRACT

An industrial shotshell has a load, such as an iron slug, assembled with a press-fitted, wad column-containing outer cup and housed with the cup in its shell. The outer cup encloses a wad column and, when pressed fitted onto a larger diameter rearward portion of the slug, seals the gases and supports the wad column during slug setback. A concavity formed in the interior of the base end of the outer cup provides empty space into which the wad column can compress during slug setback. The outer cup holds the wad column to the slug and remains attached thereto during flight, adding a degree of drag stabilization for improved accuracy of the slug and helping to stabilize the slug by changing its center of gravity. An obturating cup is formed integral at the rearward exterior of the base end of the outer cup.

16 Claims, 1 Drawing Sheet

INDUSTRIAL SHOTSHELL HAVING A LOAD-STABILIZING ASSEMBLY

The present invention generally relates to shotshells and, more particularly, is concerned with an industrial shotshell having a load-stabilizing assembly composed of a load and a wad column-containing cup press-fitted thereon.

High energy requirements of one prior art industrial shotshell load which uses an iron slug calls for a two-diameter configuration to meet weight requirements. A larger diameter rearward portion of the slug is housed in the shell, while a smaller diameter forward slug portion protrudes out of the shell through a roll crimp.

Although the slug with this configuration meets the high energy requirements, it is unstable due to the rearward weight bias of its larger diameter rearward portion, since the rearward portion is larger in mass than the forward portion. Upon firing, instability of the slug causes it to tumble in flight, resulting in poor accuracy.

Another problem encountered is the weakness of a molded fiber wad column deployed in the shell rearwardly of the slug. During slug setback upon shell firing, the slug has a tendency of blanking through the wad column, allowing gases to escape and melt a plastic liner encircling the slug for purposes of slug alignment and barrel protection.

Consequently, a need exists for improvements in the construction of an industrial shotshell which will avoid the aforementioned problems. Different wad structures are known in the prior art for commercial shotshells. Representative of the prior art are the wad structures illustrated and described in U.S. Patents to Moehlman et al (No. 3,285,174 and No. 3,669,023), Hubbard (No. 3,720,171) and Hughes et al (No. 3,721,197), all of which are assigned to the assignee of the present invention. However, none of these prior art wad structures are believed to suggest the solution to the above-described problems.

The present invention provides an improved industrial shotshell designed to satisfy the aforementioned needs. The improved industrial shotshell of the present invention includes a load-stabilizing assembly comprised of a load, such as a slug, and a press-fitted, wad column-containing outer cup. The outer cup encloses a wad column and, when pressed fitted onto the larger diameter portion of the slug, seals the gases and supports the wad column during slug setback. An empty space is provided by a concavity formed in the interior of the base end of the wad column-containing outer cup. The empty space allows deforming and compressing of the wad column into the concavity during slug setback. The outer cup in being assembled to the slug improves bore alignment.

Also, the outer cup holds the wad column to the slug and remains attached thereto during flight, adding a degree of drag stabilization for improved accuracy. As the slug goes down range, the attached cup helps stabilize the slug by changing its center of gravity.

The improved industrial shotshell also includes an obturating cup formed integral with the base end of the wad column-containing outer cup at its rearward exterior side. Alternatively, the obturating cup can be separate from the outer cup.

These and other features and advantages of the present invention will become apparent to those skilled in the art upon a reading of the following detailed description when taken in conjunction with the drawings wherein there is shown and described an illustrative embodiment of the invention.

In the course of the following detailed description, reference will be made to the attached drawings in which.

Figure 1:
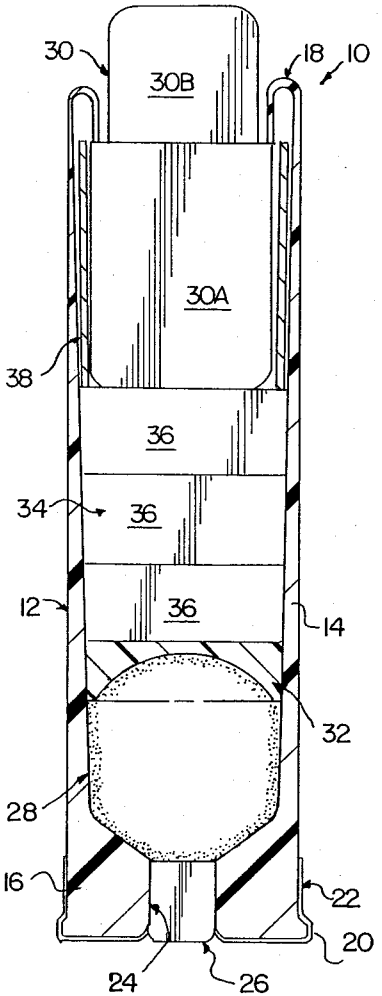
FIG. 1 PRIOR ART
FIG. 1 is a vertical axial sectional view of a prior art industrial shotshell with some components illustrated in elevation.

Referring now to the drawings, and particularly to FIG. 1, there is shown a prior art industrial shotshell, generally designated by the numeral 10. The shotshell 10 includes an outer cylindrical shell 12 having an elongated sidewall 14 with a short base 16 at one end and an open mouth at the opposite end in the form of a roll crimp 18. The sidewall 14 tapers interiorly from a maximum inside diameter at its outer portion adjacent the roll crimp 18 to a minimum inside diameter where it integrally merges into the base 16. The base 16 has an annular rim 20 enclosed by a metal head 22 and a central aperture 24 receiving a primer 26.

The shotshell 10 also includes a propellant or powder charge 28 housed at the one end of the shell 12 adjacent the forward or inner side of the base 16 and the primer 26. The shotshell 10 also has a load in the form of a steel or iron cylindrical slug 30 disposed at the opposite end of the shell 12. The slug 30 has two diameters, being composed of a larger diameter rearward portion 30A disposed in the forward one-third of the shell 12 and a smaller diameter forward portion 30B which protrudes from the one open end of the shell 12. The rearward portion 30A is larger in mass than the forward portion 30B.

An over-powder or obturating cup 32 and a wad column 34, composed of a plurality of separate, cylindrical molded fiber wads 36, are disposed in the shell 12 between the propellant charge 28 and the slug 30. A cylindrical plastic liner 38 surrounds the slug 30 for purposes of slug alignment and protecting the barrel of the gun as the slug travels through the barrel.

The above-described shotshell construction has been found unstable due to the rearward weight bias of its larger diameter rearward portion 30A. Upon firing, this instability of the slug 30 causes it to tumble in flight, resulting in poor accuracy. Another problem encountered is the tendency of the slug 30 during setback upon firing of the shotshell 10 to blank through the wad column 34, allowing gases to escape which melt the plastic liner 38 encircling the slug 30.

Figure 3:
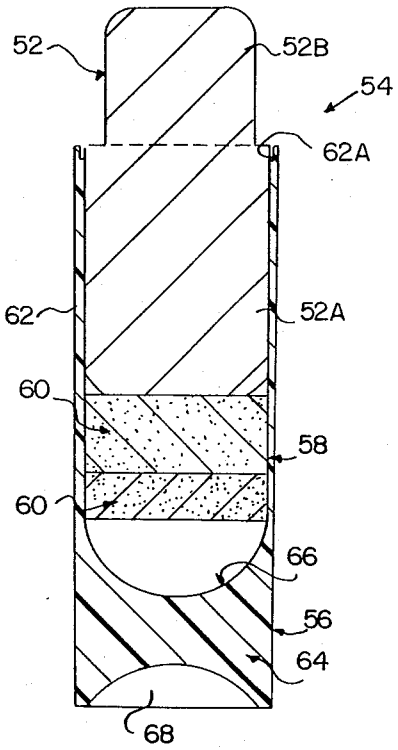
FIG. 3 is a vertical axial sectional view of a load-stabilizing assembly composed of a slug and a wad column-containing outer cup press fitted on the slug and extending rearwardly thereof.
Figure 2:
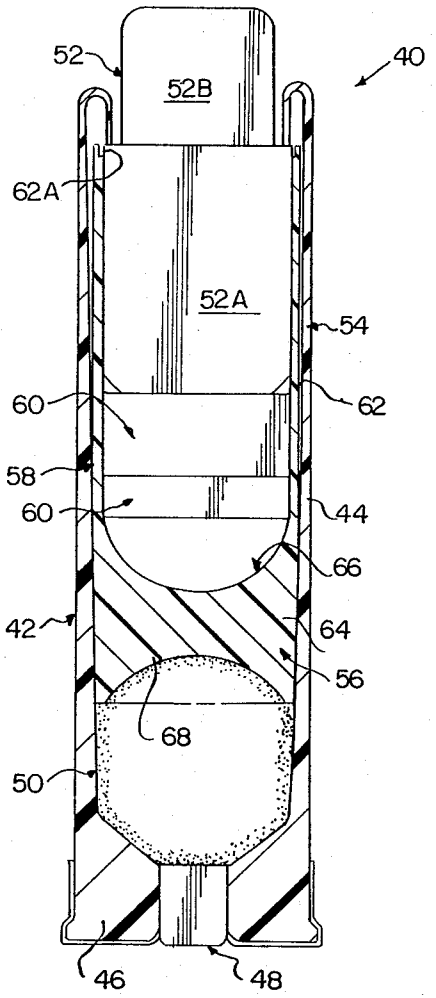
FIG. 2 is a vertical axial sectional view of an improved industrial shotshell of the present invention with some components illustrated in elevation.

Turning to FIGS. 2 and 3, there is illustrated an improved industrial shotshell, generally designated 40, and constructed in accordance with the principles of the present invention. The improved shotshell 40 includes an outer shell 42 composed of an elongated sidewall 44 and a base 46 identical to that of the prior art shotshell 10. The primer 48 and propellant charge 50 are also the same. The load in the form of a two-diameter slug 52 having rearward and forward portions 52A, 52B is also the same as the slug 30.

The improvement to the industrial shotshell 40 provided by the present invention is a load-stabilizing assembly 54, being illustrated removed from the shell 42 in FIG. 3. The load-stabilizing assembly 54 is composed of a wad column-containing outer cup 56 in combination with the slug 52. Preferably, the outer cup 56 encloses a wad column 58 which is composed of a plurality of separate cylindrical molded fiber wads 60. The outer cup 56 has a forwardly-extending cylindrical sidewall 62 and a rearward base end 64. The inside diameter of the sidewall 62 is sized to closely conform to the outside diameter of the rearward portion 52A of the slug 52 for pressed-fitted attachment of the cup thereon. The sidewall 62 of the outer cup 56 has an annular internal recess 62A defined at its forward open end which permits proper alignment of the fiber wads 60 and slug 2 with the open end of the outer cup before insertion therein.

When press-fitted thereon, the outer cup 56 seals the propellant gases and supports the wad column 58 during setback of the slug 52. A concavity 66 formed in the interior of the base end 64 of the outer cup 56 provides empty space into which the wad column 58 can compress and deform during slug setback. Due to the press-fitted attachment, the sidewall 62 of the outer cup 56 holds the wad column 58 to the slug 52 and remains attached thereto during flight. Thus, the load-stabilizing assembly stays intact during flight, adding a degree of drag stabilization for improved accuracy of the slug 52. As the slug 52 goes down range, the attached outer cup 56 with the wad column 58 helps to stabilize the slug by moving its center of aerodynamic resistance rearward of its center of gravity. The outer cup 56 in being assembled to the slug 52 also improves bore alignment.

The improved industrial shotshell 40 also includes an obturating cup 68 preferably formed integral at the rearward exterior of the base end 64 of the column-containing outer cup 56. Alternatively, the obturating cup can be separate from the outer cup. Whereas the outer cup 56 is preferably an injection molded part, it can also be a part machined from plastic bar stock.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely a preferred or exemplary embodiment thereof.

I claim:

1. A load-stabilizing assembly for an industrial shotshell, said assembly comprising:

(a) an outer cup having an elongated cylindrical forwardly-extending sidewall being open at its forward end, said outer cup also having a base end connected to said sidewall at its rearward end and closing the same;

(b) a load having rearward and forward portions, said rearward portion being greater in mass than said forward portion and extending into said open forward end of said outer cup in a press-fitted attachment therewith;

(c) a wad column disposed in said outer cup between said base end thereof and said rearward portion of said load;

(d) said base end of said outer cup having a concavity formed in an interior side thereof facing toward said wad column, said concavity providing empty space between said base end and said wad column for permitting deforming and compressing of said wad column at least partially into said concavity during setback of said load in response to firing of said shotshell;

(e) said press-fitted attachment of said outer cup to said rearward portion of said load being sufficient to hold said outer cup and said wad column therewith to said load during flight so as to add a degree of drag stabilization for improved accuracy of said load and to assist in stabilizing said load by moving its center of aerodynamic resistance rearward of its center of gravity.

2. The assembly as recited in claim 1, wherein said rearward portion of said load is also larger in diameter than said forward portion thereof.

3. The assembly as recited in claim 2, wherein said load is a metallic slug.

4. The assembly as recited in claim 1, wherein said wad column is disposed in contact with said rearward portion of said load.

5. The assembly as recited in claim 1, further comprising:

an obturating cup at the rearward exterior of said base end of said outer cup.

6. The assembly as recited in claim 5, wherein said obturating cup is formed integral with said base end of said outer cup.

7. The assembly as recited in claim 1, wherein said sidewall of said outer cup has an annular internal recess defined at its forward open end for permitting proper alignment of said wad column and said load with said forward open end of said outer cup before insertion therein.

8. The assembly as recited in claim 1, wherein said wad column is composed of a plurality of cylindrical fiber wads.

9. In an industrial shotshell including an elongated shell having a cylindrical sidewall, a base and a charge of propellant disposed forwardly of said base, a load stabilizing assembly comprising:

(a) an outer cup having an elongated cylindrical forwardly-extending sidewall being open at its forward end, said outer cup also having a base end connected to said sidewall at its rearward end and closing the same, said outer cup being disposed in said sidewall of said shell forwardly of said charge of propellant therein;

(b) a load having rearward and forward portions, said rearward portion being greater in mass than said forward portion and extending into said open forward end of said outer cup in a press-fitted attachment therewith, said rearward portion extending from said open forward end of said outer cup; and (c) a wad column disposed in said outer cup between said base end thereof and said rearward portion of said load;

(d) said base end of said outer cup having a concavity formed in an interior side thereof facing toward said wad column, said concavity providing empty space between said base end and said wad column for permitting deforming and compressing of said wad column at least partially into said concavity during setback of said load in response to firing of said shotshell;

(e) said press-fitted attachment of said outer cup to said rearward portion of said load being sufficient to hold said outer cup and said wad column therewith to said load during flight so as to add a degree of drag stabilization for improved accuracy of said load and to assist in stabilizing said load by moving its center of aerodynamic resistance rearward of its center of gravity.

10. The assembly as recited in claim 9, wherein said rearward portion of said load is also larger in diameter than said forward portion thereof.

11. The assembly as recited in claim 10, wherein said load is a metallic slug.

12. The assembly as recited in claim 9, wherein said wad column is disposed in contact with said rearward portion of said load.

13. The assembly as recited in claim 9, further comprising:

an obturating cup at the rearward exterior of said base end of said outer cup and facing said charge of propellant.

14. The assembly as recited in claim 13, wherein said obturating cup is formed integral with said base end of said outer cup.

15. The assembly as recited in claim 9, wherein said sidewall of said outer cup has an annular internal recess defined at its forward open end for permitting proper alignment of said wad column and said load with said forward open end of said outer cup before insertion therein.

16. The assembly as recited in claim 9, wherein said wad column is composed of a plurality of cylindrical fiber wads.

* * * * *